US005271565A

United States Patent [19]

Cerny

[11] Patent Number: 5,271,565

[45] Date of Patent: Dec. 21, 1993

[54] FUEL INJECTOR WITH VALVE BOUNCE INHIBITING MEANS

[75] Inventor: Mark S. Cerny, Sterling Hgts, Mich.

[73] Assignee: Chrysler Corporation, Highland Park, Mich.

[21] Appl. No.: 993,212

[22] Filed: Dec. 18, 1992

[51] Int. Cl.[5] ..... F02M 51/06

[52] U.S. Cl. ..... 239/533.8; 239/533.9; 239/533.11; 239/585.1; 251/50; 335/277

[58] Field of Search ..... 239/533.8, 533.9, 533.11, 239/533.12, 585.1, 585.4, 585.5, 584; 251/50; 335/257, 271, 277

[56] References Cited

U.S. PATENT DOCUMENTS 1,252,254 1/1918 Fisher .
1,498,034 6/1924 Hesselman .
2,769,669 11/1956 L'Orange ..... 239/584 X
4,168,804 9/1979 Hofmann .
4,186,708 2/1980 Bowler .
4,231,525 11/1980 Palma .
4,245,789 1/1981 Gray .
4,247,052 1/1981 Gray .
4,275,844 6/1981 Grgurich et al. .
4,275,845 6/1981 Müller .
4,306,680 12/1981 Smith .
4,331,317 5/1982 Kamai et al. .
4,342,427 8/1982 Gray .
4,375,274 3/1983 Thoma et al. .
4,392,612 7/1983 Deckard et al. .
4,406,404 9/1983 Horino .
4,434,765 3/1984 Eshelman .
4,515,129 5/1985 Stettner .
4,520,962 6/1985 Momono et al. .
4,572,146 2/1986 Grünwald et al. .
4,621,772 11/1986 Blythe et al. .
4,795,097 1/1989 Greiner et al. .
4,878,650 11/1989 Daly et al. ..... 251/50 X
4,971,254 11/1990 Daly et al. .
5,012,981 5/1991 Holzgrefe et al. .
5,127,585 7/1992 Mesenich ..... 239/585.5

*Primary Examiner*—Andres Kashnikow
*Assistant Examiner*—William Grant
*Attorney, Agent, or Firm*—Kenneth H. MacLean

[57] ABSTRACT

An improved fuel injector for an internal combustion engine with structure which produces a counterforce on the injector valve subsequent to valve closing to inhibit substantial rebound movement of the valve away form its seating surface as caused by the impact of valve closing accompanied by elastic deformation of a valve and its seating surface. The counterforce is generated by creation of a reduced fluid pressure between closely spaced and parallel surfaces, one on the movable valve and the other on the stationary valve guide.

10 Claims, 2 Drawing Sheets

FUEL INJECTOR WITH VALVE BOUNCE INHIBITING MEANS

BACKGROUND OF THE INVENTION

1. Field of the Invention

This application concerns an improved fuel injector of the electromagnetically actuated type for an internal combustion engine. The injector includes structure to precisely control the closing characteristic of its valve which opens and closes to regulate fuel flow to the engine. This produces an extremely accurate fuel delivery for each opening and closing cycle. In contrast, other fuel injectors exhibit relatively imprecise valve closing control which usually results in valve rebound or bounce away from the valve seat surface occurring after valve closure. This valve rebounding or bouncing produces secondary valve openings and therefore increased fuel delivery to the engine per opening and closing of the injector. The excess fuel flow decreases combustion efficiency. Also, it has been found that the fuel delivered during valve rebound is usually poorly atomized, further resulting in combustion inefficiencies.

Valve rebound results from the recovery from an elastic deformation of the valve and valve seat caused by the closing impact. The subject fuel injector inhibits significant valve rebound or bounce by generating an opposing force on the valve. The opposing force is produced by the rapid formation of a relatively low pressure of the fluid between the valve and its support structure as the valve tends to move away from the seating surface after valve closure.

2. Description of Related Art

An objective of the fuel injector is accurate fuel delivery to an associated engine or a specific combustion chamber. With an electromagnetically actuated and electronically controlled injector, a control unit or computer directs opening and closing of the valve. The subject injector is pulse width modulated which is particularly adapted for controlling fuel delivery to a single cylinder. This general type of injector is available on several vehicle engines made by Chrysler Corporation. The quantity of fuel delivered during each combustion event by the pulse width modulated injector is determined by the period of time that the computer maintains the injector valve in an opened operative position. This period of time is selected by the computer which receives various engine operating inputs such as engine speed, load, and vehicle speed. To deliver the predetermined correct quantity of fuel for each combustion event, it is expected that the valve will open and then close precisely. If the valve rebounds even once from its seating surface after closing, a considerably greater quantity of fuel may be delivered than planned. Excessive fuel delivery caused by valve rebound is amplified when the injector operates at relatively high fuel pressures.

In a pre-examination patent search, a substantial number of prior patents have been uncovered. None of these patents disclose fuel injectors or the like with means to inhibit valve rebound or bounce by producing a rebound inhibiting force due to a decreased hydraulic pressure between the surfaces of an injector valve and a support structure. The following U.S. Pat. Nos. were uncovered: 1,252,254; 1,498,034; 4,168,804; 4,186,708; 4,231,525; 4,245,789; 4,247,052; 4,275,844; 4,275,845; 4,306,680; 4,331,317; 4,342,427; 4,375,274; 4,392,612; 4,406,404; 4,434,765; 4,515,129; 4,520,962; 4,572,146; 4,621,772; 4,795,097; 4,971,254; and 5,012,981.

SUMMARY OF THE INVENTION

The subject device is a pulse width modulated fuel injector in which the fuel regulating valve is moved from a normally closed position to an opened position by activating an electromagnetic actuating device. The quantity of fuel delivered by the injector is determined by the length of time the electromagnetic device is energized. This period of time is determined by an electronic control unit or computer responding to many engine parameters or input signals, such as engine speed, vehicle speed, and engine load.

The injector's valve is moved from a normally closed position to an opened position by the energization of an electric solenoid. The valve element is closed by a return spring. Upon deactivation of the solenoid, the return spring moves the valve back to the closed position against a seating surface. This closing action creates an impact as the valve engages the seating surface. Upon closing, there can be significant elastic deformation between the valve and the seating surface. After elastic deformation occurs, a recovery force is imposed on the valve tending to produce undesirable rebounding or bouncing. The subject injector has an anti-rebound mechanism including an opposed movable valve surface and a stationary surface which are closely spaced when the valve is in a closed position. When a valve rebound begins, the closely spaced and opposed surfaces rapidly separate. This generates a rapid decrease in fluid pressure between the surfaces and produces a force on the valve which opposes rebound movement.

One of the previously mentioned surfaces is formed on the movable valve and a second of the surfaces is formed on a stationary portion of the fuel injector. Both surfaces are located upstream of the seating surface. The surfaces lie in parallel planes and are spaced very close to one another when the valve is in a fully closed position. In the subject preferred embodiment, the total valve travel in opening is only about 0.003 inches. The surfaces are spaced about 0.001 inches when the valve is closed and about 0.004 inches when the valve is opened. At the beginning of valve rebound, the pressure of fluid between the surfaces decreases rapidly and produces a subatmospheric condition between the surfaces for a short time. This produces the force on the valve opposing rebound movement. The pressure decreases for a short time because the fuel is unable to flow rapidly enough into the space between surfaces to prevent a pressure decrease due to fluid inertia and the very narrow entrance to the space.

Further advantageous features of the subject fuel injector will be more readily apparent from a reading of the following detailed description of a preferred embodiment which is illustrated in the accompanying drawings as described below.

IN THE DRAWINGS

FIG. 1 is an elevational view of the subject fuel injector mounted in a cylinder head above a combustion chamber of an internal combustion engine; and FIG. 2 is an enlarged elevational sectioned view of the subject injector in the cylinder head; and FIG. 3 is a greatly enlarged elevational sectioned view of the lower outlet portion of the subject injector shown in its closed operative condition taken along section line 3—3 in FIG. 5 and looking in the direction of the arrows; and FIG. 4 is a sectioned view taken along section line 4—4 in FIG. 5 looking in the direction of the arrows but having the valve element withdrawn past the open most position to reveal features; and FIG. 5 is a planar and fragmentary sectioned view of the subject injector taken along section line 5—5 in FIG. 4 and looking in the direction of the arrows; and FIG. 6 is an extremely enlarged view of the portion within encircled area 8 in FIG. 3 with the valve in its downwardmost closed operative position; and FIG. 7 is similar to FIG. 6 but with the valve in a slightly opened operative position assumed as the valve moves upward away from its seating surface, and FIG. 8 is a planar representation of the curved entrance to the space between the surfaces as looking in the direction of arrow A in FIG. 6.

DETAILED DESCRIPTION OF A PREFERRED EMBODIMENT

Figure 1:
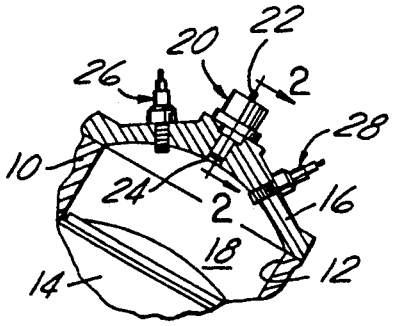

In FIG. 1, a portion of an engine block 10 is shown in which a cylinder bore 12 is formed. The upper part of a piston 14 is shown in the cylinder bore 12. A portion of cylinder head 16 is shown above the piston. As is known in the engine art, head 16 extends over bore 12 and is attached to block 10 in a sealingly engaged manner. The bore 12, piston 14 and cylinder head 16 define an engine combustion chamber 18.

A fuel injector 20 is mounted within a recess in cylinder head 16 and has electrical contacts or tabs 22 (only one is visible) at the exterior end of the injector. An interior end 24 of the injector 20 opens to the combustion chamber 18 to deliver fuel therein.

A pair of spark plugs 26, 28 are threadably mounted in the cylinder head 16. Electrical cables (not shown) direct high voltage electrical energy to the spark plugs at an appropriate time to initiate combustion of a fuel-/air mixture in chamber 18.

Figure 2:
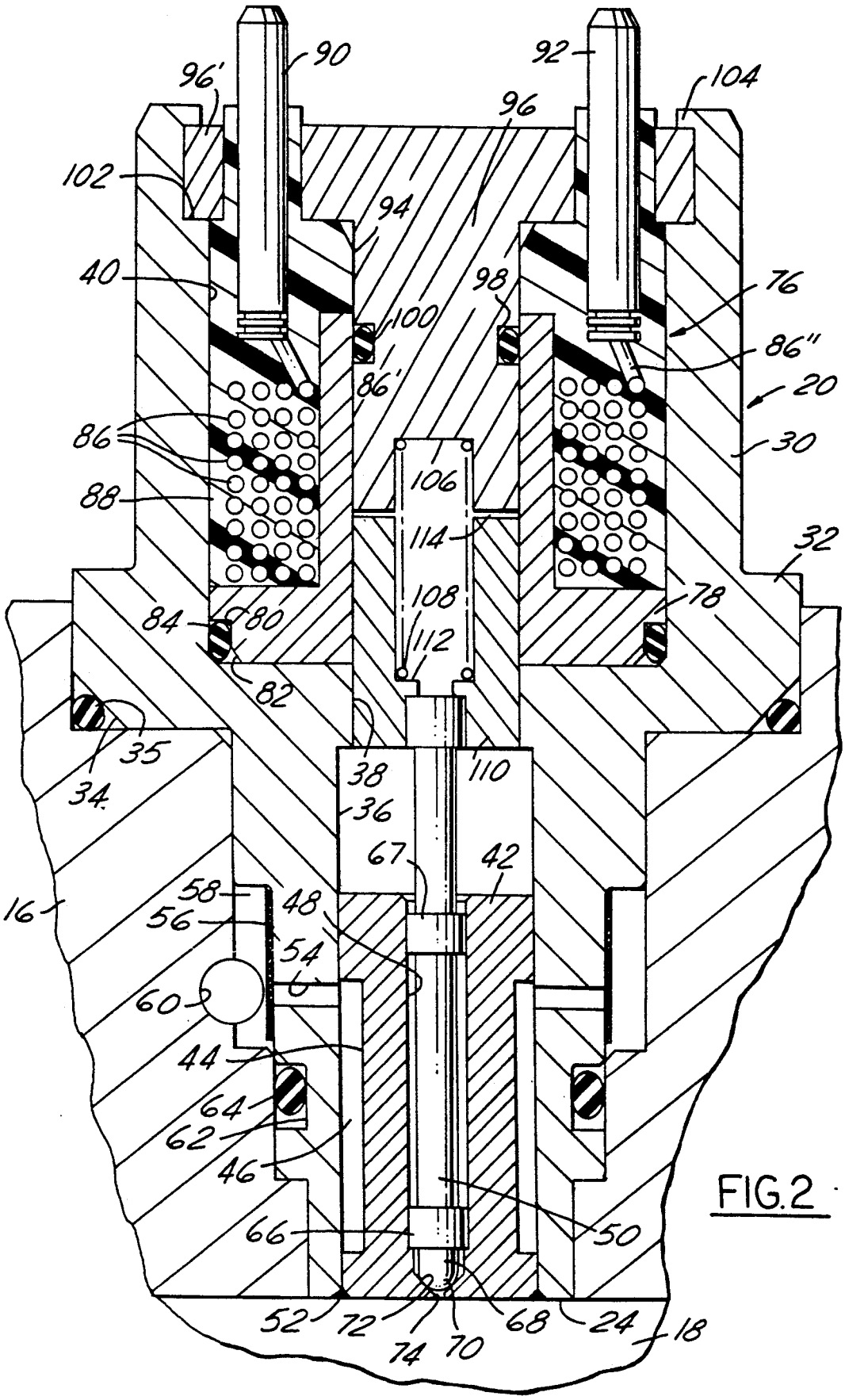

In FIG. 2, details of the subject fuel injector 20 are illustrated. The injector 20 includes a generally cylindrical housing 30 with a radially enlarged annular portion 32. The housing 30 is received within an enlarged recess in the cylinder head. The portion 32 has a beveled corner 34 which coacts with corner walls of the recess to form a pocket or cavity. An 0-ring type seal 35 is supported in the pocket to seal housing 30 relative to the cylinder head 16.

The housing 30 has coaxial bores 36, 38 and 40 therethrough. The bore 36 adjacent interior housing end 24 supports a valve guide member 42 therein. A groove or channel 44 in the midportion of guide member 42 in cooperation with the surrounding housing 30 define a fuel supply chamber 46. The guide member 42 has a central bore 48 in which an elongated valve element 50 is supported for reciprocation between closed and opened positions. The guide member 42 is attached to housing 30 at an inner end portion 24 by weld 52 which also seals the joint between members 30 and 42.

Fuel supply chamber 46 receives fuel through radially extending inlet passages 54 in housing 30. A filter or screen member 56 is wrapped about the housing 30 and overlies passages 54. The fuel passes from inlets 54 and into the chamber 46 from an annular chamber 58 formed between housing 30 and a recess in the cylinder head 16. Fuel is supplied to chamber 58 through a passage 60 which extends longitudinally through cylinder head 16. A channel 62 in housing 30 supports an 0-ring type seal 64 which prevents leakage from chamber 58.

The valve 50 has a pair of axially spaced, radially extending portions 66, 67 which are sized relative to bore 48 to allow reciprocal movements of valve 50 but to inhibit leakage of significant quantities of fuel thereby. As an alternative, the valve can have a continuous diameter configuration between portions 66 and 67. The lower end portion 68 of valve 50 is cylindrical and has a semi-spherically shaped end portion 70. When valve 50 is in the illustrated closed operative position, curved end portion 70 seats against conical seat surface 72 formed in guide member 42. When the valve end portion 70 is lifted upward from seat surface 72, a small outlet port 74 directs fuel into combustion chamber 18.

As previously mentioned, the valve 50 is adapted to be cycled from closed to opened and back to closed operative positions for each combustion event. The period of time which the valve is maintained open is controlled to vary the quantity of fuel to be delivered to the engine. An electromagnetic actuator is connected to the valve 50 to move it from a closed to an opened position. The electromagnetic actuator includes a coil assembly 76. Assembly 76 has a bobbin member 78 of elastomeric material supported within bore 40 in housing 30. The bobbin 78 has an edge or corner groove 80 which defines with housing 30 a pocket 82 for receiving an 0-ring seal 84.

The electrical portion of the coil assembly 76 includes wire 86 spirally coiled about the outer surface of the bobbin 78. The coil 86 is encapsulated within a molded elastomeric cover member 88. The opposite ends 86′ and 86″ of coil 86 are connected to electrical terminals 90, 92 which have lower portions encapsulated within the cover material 88 but which are exposed at an upper end for connection to electrical leads (not shown) from the controller.

The bobbin 78 and portions of cover member 88 define a central interior bore 94 into which a central portion of a stationary pole piece 96 is inserted. Bores 38 and 94 are coaxial and of the same diameter. At a midportion of pole piece 96, a groove or channel 98 is formed for supporting 0-ring sealing member 100. The upper end portion of the pole piece is formed into a radially enlarged head 96′ which engages a shoulder 102 formed in housing 30. An upper edge 104 portion of housing 30 is mechanically deformed or rolled over the pole piece to secure the electromagnetic actuator within the injector.

The central portion of the pole piece 96 projects downward into bore 94. A central recess 106 in the lower end of the pole piece 96 receives the upper end of a coil type spring 108. An armature member 110 is supported in bores 38, 94 beneath pole piece 96 and is sized to permit axial reciprocation therein. Armature 110 is of magnetically responsive material so as to respond to magnetic flux produced by energization of coil 86. The upper end of the armature 110 has a recess 112 to receive the lower end of the coil spring 108. The upper end of valve 50 is connected to armature 110 so as to move as a unit in the axial direction defined by bores 38, 48 and 94. Specifically, the armature and valve moves upward to an opened position in response to energization of the coil 86 and moves downwardly to a closed position by force of the spring 108 when the magnetic field collapses. The small axial gap 114 between the pole piece 96 and armature 110 defines the maximum opening lift of valve end 70 from seat 72.

Figure 3:
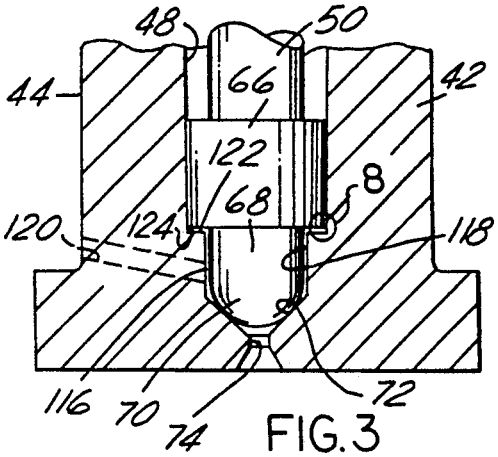
Figure 4:
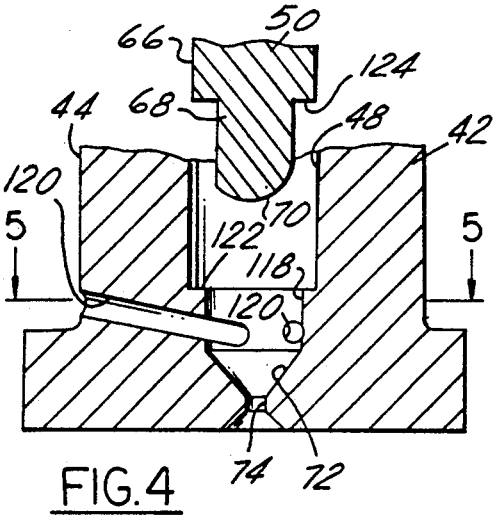

The outlet or lower end portion of the injector 20 is shown in FIGS. 3 and 4 on an enlarged scale. In FIG. 3, valve 50 is shown in its normal closed operative position with its semispherical end portion 70 seated against the conically shaped seating surface 72. The fit between the radially enlarged portions 66, 67 and bore 48 is close to inhibit leakage of fuel therebetween but allowing reciprocation of the valve 50.

A narrow annular chamber 116 is formed between the guide member 42 and the cylindrical end portion 68 of valve 50. The radial spacing or width of this chamber 116 is one-half the difference in the diameters of bore 118 and of cylindrical end 68. In the preferred working embodiment, this radial width is only 0.1 millimeters and the height of chamber 116 is only about one millimeter and thus the volume is only about 0.6 cubic millimeters. The volume of the space beneath end portion 66 disregarding valve end 70 is about 3.1415 cubic millimeters. Therefore, chamber 116 is only about 19 percent of the total space.

Figure 5:
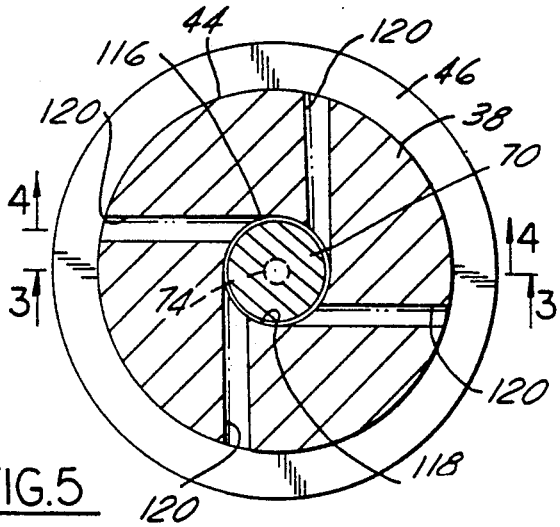

FIG. 4 is a sectional view along line 4—4 in FIG. 5 and is similar to FIG. 3 but with valve 50 moved upward far past its normal opening movement as defined by gap 114. It is moved sufficiently upward to open up the area formed by bore 118 so that the structure can be seen. This better reveals the four fuel inlet passages 120 entering chamber 116. Each inlet passage 120 has a small diameter of only about 0.4 millimeters so that fuel more quickly flows into space 116 at high velocity as the end 70 lifts from seat 72.

As best seen in FIG. 5, inlet passages 120 extend from chamber 46 through the outer surface 44 of guide member 42 past the inner surface forming bore 118 and into space 116. The inlet passages 120 are oriented in guide member 42 so that they discharge fuel tangentially into the narrow space 116. Almost instantaneously after end 70 lifts from seat 72, fuel swirls in a generally rotative direction about chamber 116. When the valve is opened, the fuel flows past seating surface 72 and is discharged from the outlet port 74 into the associated combustion chamber. Testing confirms that this construction and resultant action promotes a very fine atomization of fuel. This produces an average fuel particle size of about ten microns or less when the fuel pressure is about 1000 psi.

As previously explained, a desired quantity of fuel is delivered by the injector and controlled by opening and then closing the injector's valve 50 for a period of time directed by the computer based on inputs such as engine speed and load. However, the period of valve opened time is calculated assuming a precise closing action of valve element 50. As indicated, previous injectors do not close very precisely. The impact of the valve with the seating surface produces an upward force tending to cause rebound of the valve after the initial closing contact. During rebound, excess fuel can be delivered to the combustion chamber resulting in inefficient combustion and lower fuel economy.

The subject fuel injector is characterized by a very precise valve closing for each combustion event. Rebound or bounce of the valve is caused by the elastic deformation between valve and valve seat caused by the valve's closing impact. Rebound is inhibited by counteracting the impact induced force with a hydraulic vacuum-like force generated between the valve and its support structure. Specifically, the valve guide member 42 has an annular shoulder surface 122 formed thereon. Preferably, the shoulder is in a plane normal to the axis of the bore 48. The enlarged lower end portion 66 of valve element 50 defines a similar annular surface 124 which is also preferably normal to the axis of bore 48 and the valve 50. The surfaces 122 and 124 are parallel to one another and are spaced closely to one another, even more so when the valve is closed as in FIG. 6. As the valve 50 begins to open as shown in FIG. 7, surface 124 is moved upward and away from surface 122.

Figure 6:
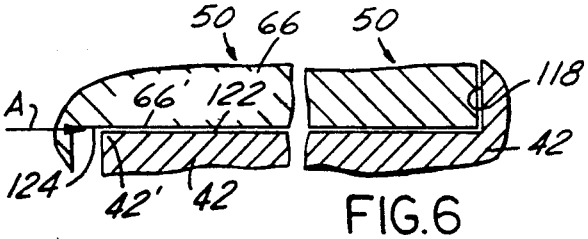
Figure 8:
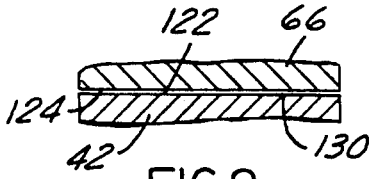
Figure 7:
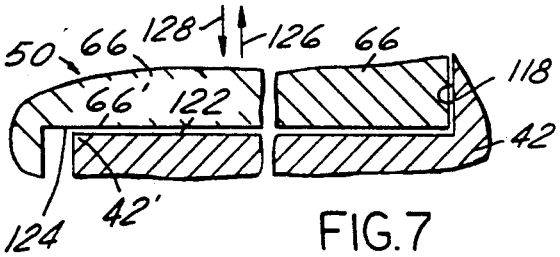

In the preferred embodiment, the surfaces 122, 124 are separated only about 0.001 inches when the valve is fully closed as shown in FIGS. 6 and 8. In FIG. 7, the valve has moved slightly upward from the closed position of FIG. 6 towards its opened position. The initial opening valve movement along with the separation of closely spaced surfaces 122, 124 is illustrated from FIG. 6 to FIG. 7 and described above. The separating movement occurs during the rebound or bounce of valve 50 due to its impact with the valve seat surface 72. The valve's upward rebound movement is due to upward force 126 shown in FIG. 7 which is applied on valve 50 by the release of the elastic deformation of the impact collision between members 70, 72. The initial rapid separation of surfaces 122, 124 instantaneously produces a low pressure of fluid trapped between the surfaces. This low pressure, akin to vacuum pressure, is below the pressure exerted on other surfaces of the valve 50. Momentary, a downwardly directed force 128 is imposed on the valve 50 due to the low or vacuum condition. The force 128 greatly inhibits any rebound or bounce of valve 50 away from the seating surface 72.

As previously mentioned, force 128 opposes valve rebound or bounce. The force 128 is instantaneously created by the rapid separation of the closely lying surfaces 122, 124. This rapidly developed force 128 is generated because of the inability of any sufficient amount of fluid to flow back into the quickly expanding space between the surfaces 122, 124 due to fluid inertia. Also, the resistance of fluid to flow adjacent and along the surfaces also prevents any significant fluid flow into the expanding space. In FIG. 8, the very narrow entrance 130 to the space is shown and its length is equal to the circumference of the region defined by portions 42' and 66'. The height of narrow entrance 130 is defined between opposing portions 42' an 66' of members 42 and 66. As surfaces 122, 124 separate, the height of entrance 130 increases but not before a low fluid pressure is produced in the space between the surfaces. In a real embodiment, the height might increase from 0.001 to 0.002 inches and the volume of the space would double. Still the entrance at 0.002 inches is extremely narrow and inhibits flow of any significant fluid into the space. However, the low pressure condition does not endure for a long period of time but the time is sufficient to creates opposing force 128 which inhibits rebound or bounce of the valve 50.

Although only one embodiment has been illustrated and described in detail, it should be understood that modifications are contemplated which fall within the scope of the invention as defined by the following claims.

What is claimed is as follows:

1. An improved fuel injector for an internal combustion engine, comprising: a housing enclosure means with an outlet aperture at one end for delivering fuel to the engine; a valve seating surface adjacent the aperture; a valve element with an end portion adapted to engage the seating surface to block fuel flow to the aperture when the valve element is in a closed operative position; the valve element being supported to permit opening movement away from the seating surface which allows fuel to flow to the outlet aperture; a spring yieldably urging the valve element toward the closed position and its end portion against the seating surface, whereby contact of end portion with the valve seating surface associated with a closing movement of the valve element generates an opening force on the valve element tending to cause the valve to rebound from the seating surface; a pair of closely spaced surfaces upstream of the outlet aperture generally parallel to each other and extending normal to the direction of valve movement, a first of said pair of surfaces associated with the housing and being stationary, the second of said pair of surfaces being carried by the movable valve element; the first and second surfaces being positioned in opposing and closely spaced relation to one another when the valve element is in its closed operative position whereby a rebounding movement of the valve element away from the seating surface instantly creates a reduced fluid pressure condition between the closely spaced surfaces and a resultant force is produced on the valve element in opposition to a rebounding force thus inhibiting rebound movements.

2. The improved fuel injector set forth in claim 1 in which the housing enclosure means includes a valve guide member which include an internal bore in which the valve element reciprocates and the valve seating surface adjacent the outlet aperture; the internal bore of the valve guide member having a shoulder which defines the first surface; the valve element having a corresponding shoulder which defines the second surface opposed to the first surface; the engagement of the valve element's end portion with the seating surface defining the close spacing between the first and second surfaces.

3. The improved fuel injector set forth in claim 2 in which the first and second surfaces are separated only about 0.001 inch when the valve element is in the closed operative position.

4. The improved fuel injector set forth in claim 2 in which the corresponding shoulders of the valve guide member and valve element form the only entrance to the space between the closely spaced surfaces, the entrance characterized by a narrow height dimension which is restrictive to fluid flow into the space between the first and second surfaces whereby a reduced fluid pressure is created between the surfaces as they are quickly separated as the valve element moves the second surface away from the first surface when a valve rebound occurs.

5. The improved fuel injector set forth in claim 4 in which the first and second surfaces are separated only about 0.001 inch when the valve element is in the closed operative position.

6. An improved fuel injector for an internal combustion engine, comprising: a tubular housing enclosure; a valve guide member supported in one end portion of the housing enclosure; an outlet aperture in one end of the guide member for delivering fuel to the engine, the valve guide member having a valve seating surface adjacent the outlet aperture; a valve element reciprocally supported within the guide member and having an end portion configured to sealingly engage the seating surface to prohibit flow of fuel through the outlet aperture when the valve element is in a closed operative condition; means to selectively move the valve element and its end portion away from the seating surface to permit fuel to flow to the outlet aperture; a spring yieldably biasing the valve element and its end portion against the seating surface; a first surface formed on the guide member being substantially normal to the direction of valve movement; a second surface formed on the valve element lying substantially parallel to the first surface on the guide member; the first and second surfaces being closely spaced one from the other when the valve's end portion is against the seating surface, whereby a movement of the valve element away from the seating surface during a rebound instantly creates a reduced fluid pressure condition between the closely spaced surfaces and a resultant force is produced on the valve element in opposition to rebounding force thus inhibiting rebound movements.

7. The improved fuel injector set forth in claim 6 in which the internal bore of the valve guide member has a shoulder which defines the first surface; the valve element having a corresponding shoulder which defines the second surface opposed to the first surface; the engagement of the valve element's end portion with the seating surface defining the close spacing between the first and second surfaces.

8. The improved fuel injector set forth in claim 7 in which the first and second surfaces are separated only about 0.001 inch when the valve element is in the closed operative position.

9. The improved fuel injector set forth in claim 6 in which the first and second surfaces of the valve guide member and valve element form the only entrance to the space between the closely spaced surfaces, the entrance characterized by a narrow height dimension which is restrictive to fluid flow into the space between the first and second surfaces whereby a reduced fluid pressure is created between the surfaces as they are quickly separated as the valve element moves the second surface away from the first surface when a valve rebound occurs.

10. The improved fuel injector set forth in claim 9 in which the first and second surfaces are separated only about 0.001 inch when the valve element is in the closed operative position.

* * * * *